thickness of about 10 μ at this time). Next, by thermally setting the pasty layer for 1 hour at 70°C, a photosensitive layer was obtained.

On the photosensitive member was applied a positive 6KV corona discharge and then simultaneous irradiation of an optical image with AC corona discharge. Next, the whole surface as exposed to light to obtain an electrostatic latent image. The latent image was developed by the magnetic brush method using a developer containing negative toner. A sharp image with high contrast was obtained.

The photosensitive member was free from bubbles and wrinkles, was flat and rigid, and was strong and highly sensitive.

EXAMPLE 8

An insulating layer was obtained by first peeling off the polyester film from the photosensitive member produced in *Example* 7 and in its place a coating of epoxy resin and clear paint was applied by spraying on the photosensitive layer to a thickness of about 30 μ. The layer was hardened thermally at 150°C for 1 hour, and thus an insulating layer was formed.

The image obtained by using this photosensitive member and by following the same procedure as *Example* 7 was sharp and of high contrast. Since this photosensitive member had a hard surface of thermosetting resin, it was especially good with respect to durability.

EXAMPLE 9

A photosensitive member was produced by using unsaturated polyester resin (Rigolac 2004 produced by Riken Goseikako Co.) instead of the epoxy resin used in *Example* 7.

As a result of following the same procedure as *Example* 7 using this photosensitive element, an image of high contrast like the one obtained in *Example* 7 was obtained.

The photosensitive member was flat, free from bubbles and wrinkles, rich in rigidity, strong, and highly sensitive.

EXAMPLE 10

On a size A4 flat aluminum plate 1 mm thick was coated by spraying a mixture prepared by dispersing uniformly 100 parts of photoconductive cadmium sulfide having an average diameter of 1 μ into 50 parts (containing 10 parts of solid matter) of the copolymer solution of vinylchloride and vinyl acetate so that the thickness after drying was about 60 μ. After drying, a polymeric liquid form resin prepared by mixing 20% of H-92 hardener of Nihon Goseikako Co. with epoxy resin 815 of Shell Petroleum Co. was squeegeed on the surface of the photosensitive layer with a rubber squeegee to produce a uniform thin coating of the resin solution. By this treatment, the porous surface of the photosensitive layer was filled with the above-mentioned resin solution and a thin resin layer was formed on the photosensitive layer. The liquid resin was then hardened by curing at 70°C for 2 hours. Next a polyester film 25 μ thick was applied to the surface of the resin layer using the same 815-H-92 liquid resin. At this step the excessive resin was forced out from one side by squeezing the film with a rubber squeegee so that an adhesive layer 2 to 5 μ thick was produced. In conventional processes where prior filling of the pores was not accomplished, during this step the adhesive permeated into the photoconductive layer and caused the photoconductive layer to become nonuniform in property. However, such things never happened in the case of this method. Next, the resin was hardened for 2 hours at 72°C and thus the desired photosensitive member was obtained.

Next, a corona discharge of positive 6KV was applied to the surface of the photosensitive member followed by simultaneous negative 6KV corona discharge and irradiation of the optical image having an intensity of about 3 lux seconds and then the entire surface was subjected to an irradiation of light. The latent image thus formed was developed by the magnetic brush method using a negative toner. An extremely good quality image as obtained. After this, the image was transferred to another paper by pressing, the toner remaining on the photosensitive member was wiped off. The photosensitive member was subjected to repeated cycling of the above-mentioned procedure. A good quality image was obtained each time. Since the photosensitive member produced by this method used epoxy resin, it had a favorable mechanical strength.

EXAMPLE 11

By using as the adhesive for the insulating layer a hotmelt type adhesive composed mainly of vinylchloride in place of the epoxy resin of *Example* 10, adhesion was carried out while heating. A result almost similar to *Example* 10 was obtained. In this case also, almost all the hotmelt adhesive permeated into the porous surface of the photoconductive layer in cases where no measures were taken to prevent the permeation.

EXAMPLE 12

A melamine resin clear paint containing hardener was used in place of the permeation preventive treatment using the epoxy resin in *Example* 10 and permeation preventive treatment was carried out by coating said clear paint thinly by spraying, followed by curing by heating for 2 hours at 90°C.

The result obtained was almost the same as obtained in the case of *Example* 10.

EXAMPLE 13

Instead of applying the polyester film in *Example* 10, a melamine resin clear paint containing hardener was coated by spraying to a thickness of about 25 μ, and then hardened by heating for 2 hours at 90°C.

The image obtained was of good quality and, since a thermosetting resin was used, the mechanical strength of the surface of the photosensitive member was extremely remarkable. In this case also, when no permeation preventive means was taken, the permeation of melamine resin was extensive and a uniform insulating layer was difficult to obtain.

EXAMPLE 14

The same result as obtained in *Example* 13 was obtained by using a one solution type epoxy resin paint Acmex V-56B (product of Nihon Goseikako Co.) in place of the melamine resin clear paint in *Example* 13 and by hardening for 4 hours at 120°C.

EXAMPLE 15

The same good result as obtained in *Example* 10 was obtained by carrying out the permeation preventive process by coating and permeating a liquid prepared by dispersing fine grains of silicon oxide into water in place of carrying out the permeation preventive pro-

BICHARGE PHOTOCONDUCTIVE ZINC OXIDES CONTAINING IODINE

This invention relates to bicharge photoconductive zinc oxides and methods of making them. Unlike ordinary photoconductive zinc oxides which perform well in negative charge photocopying, a bicharge zinc oxide can accept and discharge both negative and positive charges in a controlled manner which affords the production of either negative or positive photocopy. This dual capability adds much flexibility to the practical use of photocopy papers coated with the photoconductive zinc oxide. The bicharge capability is particularly useful and desirable in the microfilm copying art.

Commercially available bicharge zinc oxides are off-colored and produce low quality, speckled photoprints. The poor quality reproduction occurs in the positive charge mode (positive corona surface charge, subsequently developed with a negatively charged toner) and in reversal photocopying. The reversal process is particularly useful in copying microfilm where the negative microfilm is enlarged and reproduced as a positive print. This is accomplished by placing the photoimage, by light reflection, onto a negatively charged photoconductive surface. Subsequent development with a negatively charged toner yields the desired and conventional positive print.

I have discovered a simple, direct process for converting ordinary photoconductive zinc oxide into a white (i.e., colorless) bicharge photoconductive material which, when coated on photoprint paper, provides good quality photoprints in both positive charge and reversal modes. In this process elemental iodine, or organic or inorganic iodides, are mixed with the zinc oxide. The mixture, containing 0.005 to 0.1 weight percent of iodine (or its equivalent in iodide form), is heated in air at 100–500°C. The residence time is selected to distribute the iodine or iodide uniformly throughout the mass of zinc oxide. In a preferred embodiment zinc oxide mixed with 0.02–0.05 weight percent of iodine, or the equivalent in iodide form, is heated in static air at 200–400°C. for about 10–30 minutes. The resulting bicharge product is somewhat whiter than the starting zinc oxide, and is free flowing and odorless. A similar product is obtained by heating zinc oxide in an atmosphere of gently moving air containing an equivalent quantity of iodine or of a volatile iodide from an upstream source.

An effective alternative for adding the iodine is to dissolve it in a solvent such as water or carbon tetrachloride in which the zinc oxide is suspended. The resulting slurry is filtered, dried, and then heated in air to yield a bicharge photoconductive zinc oxide.

As mentioned above, the iodine may be provided as the element, or as an organic or inorganic iodide, including hydrogen iodide. Practically all of the iodine is retained when elemental iodine or inorganic iodides are used. Some iodine loss occurs when volatile organic iodides such as methyl and ethyl iodide are employed.

High quality positive charge and reversal photoprints require high positive charge acceptance (i.e., high positive charge saturation voltage) and decreased rate of dark decay of the acquired positive charge. The data in Table I show that the best bicharge photoproperties occur in the 0.01–0.03 weight percent iodine range where the positive saturation voltage is considerably higher than that of the untreated zinc oxide, and the rate of positive dark charge decay is considerably lower. This combination produces the contrast necessary to provide good quality positive charge and reversal photoprints. Table I also shows the relationship between bicharge photoprint quality and rate of dark decay of the positive charge in volts per second. The quality of the photoprints was scaled, by visual inspection, as follows: 6 = very poor; 5 = poor; 4 = fair; 3 = acceptable; 2 = moderately good; 1 = good. The scaling was based on print brightness, cleanliness, contrast, and speckling. For commercial practice, the print quality numerical ratings should be less than 4.

TABLE I

Bicharge Photoproperties and Print Quality of Papers Coated with Iodine-Treated PC Zinc Oxide. Effects of Iodine Concentration. All Samples Heated in Air at 400°C for 20 Minutes.

| Sample | Wt.% Iodine | Charge | Saturation Voltage | Dark Decay Rate V/Sec | Photoprint Quality Reversal (−charge) (−toner) | Photoprint Quality Positive (+charge) (−toner) |
|---|---|---|---|---|---|---|
| 1 | — | − | 875 | 14.5 | 6 | |
| | — | + | 760 | 19.0 | | 6 |
| 2 | 0.003 | − | 850 | 12.5 | 5 | |
| | | + | 785 | 17.5 | | 5 |
| 3 | 0.01 | − | 870 | 14.5 | 2 | |
| | | + | 740 | 12.5 | | 2 |
| 4 | 0.03 | − | 910 | 15.5 | 1 | |
| | | + | 810 | 12.0 | | 1 |
| 5 | 0.06 | − | 885 | 20.5 | 3 | |
| | | + | 800 | 14.0 | | 3 |
| 6 | 0.12 | − | 920 | 20.0 | 4 | |
| | | + | 835 | 17.0 | | 4 |
| 7 | 0.30 | − | 935 | 22.5 | 4 | |
| | | + | 850 | 17.0 | | 4 |

The data in Table II show that whereas bicharge print quality, in comparison with the untreated zinc oxide, is noticeably improved by heating the iodine-zinc oxide admixture over a wire temperature range of 100–500°C., the preferred heating range is 100–400°C.

TABLE V-continued

Bicharge Photoproperties and Print Quality of Papers Coated with PC Zinc Oxides Treated with Organic Halides. Samples Heated in Air at 400°C.

| Sample | Additive | Wt. % as Iodine or Equivalent | Charge | Saturation Voltage | Dark Decay Rate V/Sec | Photoprint Quality Reversal (−charge) (−toner) | Positive (+charge (−toner |
|---|---|---|---|---|---|---|---|
| 28 | Iodoform | 0.08 | − | 985 | 29.0 | 2 | |
| | | | + | 895 | 15.0 | | 1 |

The data in Table VI show that inorganic iodides, such as those of potassium, zinc, aluminum, and tin, produce beneficial bicharge effects. The samples were heated in air at 400°C.

TABLE VI

| Sample | Additive | Wt. % as Iodine or Equivalent | Charge | Saturation Voltage | Dark Decay Rate V/Sec | Photoprint Quality Reversal (−charge) (−toner) | Positive (+charge) (−toner) |
|---|---|---|---|---|---|---|---|
| 29 | Stannic Iodide | 0.04 | − | 915 | 21.0 | 3 | |
| | | | + | 855 | 14.5 | | 3 |
| 30 | Potassium Iodide | 0.04 | − | 890 | 20.0 | 1 | |
| | | | + | 790 | 14.0 | | 5 |
| 31 | Zinc Iodide | 0.04 | − | 878 | 16.0 | 1 | |
| | | | + | 790 | 12.0 | | 3 |
| 32 | Aluminum Iodide | 0.04 | − | 860 | 11.0 | 3 | |
| | | | + | 850 | 17.0 | | 3 |

The following are illustrative examples of the conversion of zinc oxide to bicharge zinc oxide:

Example 1

To a 120 g. sample of conventional photoconductive zinc oxide (French process zinc oxide prepared by the combustion in air of purified zinc vapor), having an average particle size of 0.22 $\mu$, were added 36 mg. (0.03 wt.%) of pulverized iodine. The mixture was shaken and tumbled periodically for several minutes, then heated in a covered pyrex dish at 400°C for about 20 minutes. The relatively high vapor pressure of iodine ensures a uniform distribution of iodine throughout the mass of zinc oxide. Analysis of the white product showed essentially quantitative retention of the iodine.

EXAMPLE 2

To a slurry of 160 g. of conventional photoconductive zinc oxide in 350 ml. carbon tetrachloride were added 32 mg. (0.02 wt.%) iodine dissolved in 50 ml. of carbon tetrachloride. After stirring for 15 minutes, the slurry was filtered, and the cake was dried in air at 110°C for one hour, then pulverized. The product was white.

EXAMPLE 3

To a slurry of 160 g. of conventional photoconductive zinc oxide in 300 ml. water were added 32 mg. (0.02 wt.%) of iodine dissolved in 200 ml. water. After stirring for 15 minutes, the slurry was filtered, and the cake was dried in air at 100 °C for 2 hours, then pulverized. The product was white.

EXAMPLE 4

To 160 g. of conventional photoconductive zinc oxide were added 66 mg. of pulverized iodoform ($CHI_3$). The mixture, after tumbling, was heated in a covered glass dish at 400°C for about 20 minutes. The product was white.

EXAMPLE 5

To 200 g. of conventional photoconductive zinc oxide were added 135 mg. methyliodide (liquid, equivalent to 0.06 wt.% iodine). The mixture was tumbled for several minutes, then heated in a covered glass dish at 200°C for about 20 minutes. The white product contained 0.037 weight percent of iodine.

EXAMPLE 6

To 160 g. of conventional photoconductive zinc oxide were added 84 mg. pulverized potassium iodide (equivalent to 0.04 wt.% iodine). The mixture, after tumbling, was heated in a covered glass dish at 400°C for about 20 minutes. The product was white.

For testing the bicharge photoconductive zinc oxides were applied to a conductive base paper (Weyerhaeuser Base M) at a coating weight of 20 pounds per 3000 square feet. The coating mixture was composed of:

| | |
|---|---|
| Zinc oxide | 140 g. |
| Modified Acrylic resin (DeSoto E-041, 45% non-volatile solids) | 44 g. |
| Toluene | 110 g. |
| Dye Sensitizer; solution of 7.5 mg. Bromophenol Blue and 7.5 mg. Uranine in 6 ml. methanol | |

The coated papers were dark-adapted overnight. Electrical measurements on small samples of the coated papers were made on an M/K Stati Tester. The corona was charged to 6000 volts with a current flow of 25 microamperes in both negative and positive mode. Exposure to the corona charge was for about one second, after which the sample was retained in a dark chamber for 10 seconds to measure the rate of charge decay.

The photoprints were made and developed in an SCM Copier, Model 33 in which 6000 volts at 25 microamperes were applied to the corona unit. The papers were charged for 1½ seconds, then imaged by exposure to 40 footcandles of light reflected from the master print for 1½ seconds. The reversal prints were made by charging with a negative corona, then developing with a negatively charged toner (Clopay RSX-117). The positive prints were made by charging with a positive corona, then developing with the negatively charged toner.

The iodine compounds, other than elemental iodine, which are effective in the method of the invention include both organic and inorganic iodides such as metal iodides, hydrogen iodide, alkyl and aryl mono and polyiodides.

I claim:

1. A method of producing bicharge photoconductive zinc oxide which comprises heating photoconductive zinc oxide in air to a temperature of from about 100°C to about 500°C. in the presence of iodine in an amount of from about 0.005 to about 0.1 percent by weight of the zinc oxide or an inorganic or organic iodide containing an equivalent amount of iodine for a time sufficient to distribute uniformly said iodine or iodide throughout the mass of said zinc oxide.

2. A method as defined in claim 1 wherein the time of heating is from about 10 to about 30 minutes.

3. A method as defined in claim 1 wherein iodine or inorganic or organic iodide is contacted with the zinc oxide admixed in a stream of air.

4. A method as defined in claim 1 wherein the zinc oxide is admixed with a solution or suspension of iodine or inorganic or organic iodide is mixed with the zinc oxide before heating in the presence of air.

5. Bicharge photoconductive zinc oxide produced by the process of claim 1.

* * * * *